US008986053B2

(12) United States Patent
Hermann et al.

(10) Patent No.: US 8,986,053 B2
(45) Date of Patent: Mar. 24, 2015

(54) SLIP RING BRUSH AND HOLDER FOR SLIP RING BRUSH

(71) Applicant: Schleifring und Apparatebau GmbH, Fürstenfeldbruck (DE)

(72) Inventors: Matthias Hermann, München (DE); Christian Holzapfel, Fürstenfeldbruck (DE); Peter Heinbuch, Fürstenfeldbruck (DE)

(73) Assignee: Schleifring und Apparatebau GmbH (DE)

( * ) Notice: Subject to any disclaimer, the term of this patent is extended or adjusted under 35 U.S.C. 154(b) by 37 days.

(21) Appl. No.: 13/783,997

(22) Filed: Mar. 4, 2013

(65) Prior Publication Data

US 2013/0237102 A1 Sep. 12, 2013

(51) Int. Cl.

| | |
|---|---|
| ***H01R 11/03*** | (2006.01) |
| ***H01R 4/38*** | (2006.01) |
| ***H01R 39/24*** | (2006.01) |
| *H01R 4/42* | (2006.01) |
| *H01R 39/39* | (2006.01) |

(52) U.S. Cl.

CPC .. *H01R 4/38* (2013.01); *H01R 4/42* (2013.01); *H01R 39/24* (2013.01); *H01R 39/39* (2013.01)

USPC ..... 439/792

(58) Field of Classification Search

CPC ..... H01R 4/38; H01R 39/24; H01R 4/42; H01R 39/39; H01R 11/03; H01R 39/08; H01R 39/18; H01R 39/36; H01R 39/34

USPC ..... 439/792, 803, 442, 877

See application file for complete search history.

(56) References Cited

U.S. PATENT DOCUMENTS

| | | | | |
|---|---|---|---|---|
| 2,093,198 | A | 9/1937 | Kleinmann | |
| 2,716,684 | A | 8/1955 | Barnes | |
| 3,316,519 | A | 4/1967 | Maytone | |
| 4,513,495 | A * | 4/1985 | Kimberlin | 29/597 |
| 4,705,976 | A * | 11/1987 | Cacioppo et al. | 310/232 |

FOREIGN PATENT DOCUMENTS

| | | |
|---|---|---|
| DE | 69414687 T2 | 6/1999 |
| EP | 0662736 A1 | 11/1998 |
| EP | 1453155 A2 | 3/2007 |

* cited by examiner

*Primary Examiner* — Javaid Nasri

(74) *Attorney, Agent, or Firm* — Yakov Sidorin; Quarles & Brady LLP

(57) ABSTRACT

A slip ring brush includes a holding device made of two U-shaped holding plates inserted into each other. A holding plate includes clamping fingers which, disposed opposite of one another in pairs, form cavities that accommodate brush wires. The brush wires are tightly clamped inside these cavities by clamping fingers and are secured by additional clamping sleeves.

12 Claims, 4 Drawing Sheets

SLIP RING BRUSH AND HOLDER FOR SLIP RING BRUSH

CROSS-REFERENCE TO RELATED APPLICATIONS

This application claims priority from German Patent Application No. 10 2012 203 842.6 filed on Mar. 12, 2012, the disclosure of which is incorporated by reference in its entirety.

TECHNICAL FIELD

The invention relates to a holder for a slip ring brush and a respective slip ring brush. Slip ring brushes are used in slip ring arrangements for transmitting electrical signals between mutually rotatable parts. At least one slip ring brush that includes an electrically conductive material will slide on a slideway made of electrically conductive material. As a result of the galvanic contact between the slideway and the slip ring brush it is possible to transfer electric current between them.

BACKGROUND

EP 0 662 736 A1 discloses a multi-fiber brush with a plurality of brush wires in which the individual brush wires are soldered into a sleeve. Several of such sleeves are integrated with (for example, by soldering) a carrier. This leads to a series of soldered electrical contact points. Such complex structural configuration is highly prone to various malfunctions.

U.S. Pat. No. 3,316,519 also discloses a multi-fiber brush, in which the individual wires are soldered into a brass body. Only one soldering point is disposed in the path of electric current. While good mechanical relief is achieved by the deep penetration of the individual brush wires into the brass body and a relatively massive soldering point, the disadvantage of this arrangement stems from its complex configuration and the relatively high complexity of the brass body. Moreover, parallel switching of several proposed brushes can be achieved only by external wiring.

EP 1 453 155 A2 discloses a slip ring brush in which the individual wires are soldered onto the surface of a printed circuit board. While simple parallel switching between and/or among the brushes is possible in this case, the disadvantageous aspect is the high level of operational susceptibility to malfunctions due to mechanically loaded soldering points. Moreover, this arrangement is not suitable for the use of multi-fiber brushes, which, in comparison with the use of individual brushes, could offer substantially better current transmission properties.

SUMMARY

The embodiments of the present invention are directed to an assembly including a structural cooperation between a slip ring brush and a holder for slip ring brush(es), where one or more brush wires can be used in an individual brush, where simple parallel connection of several brushes is possible, and which is characterized by increased operational reliability in combination with reduced production costs.

In an embodiment, a slip ring brush includes a holding device with at least one first holding plate and a second holding plate disposed above the first holding plate. Each of the two holding plates include an attachment area with at least one clamping finger. At least one clamping finger of the first holding plate is disposed opposite a clamping finger of the second holding plate and forms a cavity for holding at least one brush wire. Preferably, several such clamping fingers are arranged in parallel and disposed opposite one another in pairs to form several cavities. A single brush wire or a plurality of brush wires (forming a multi-fiber brush, for example) is held in such a cavity. For the purpose of fixing the brush wires, a clamping sleeve encompasses at least one clamping finger of the first holding plate and the respectively oppositely disposed clamping finger of the second holding plate and at least one brush wire encompassed in the cavity formed by the clamping fingers. The clamping sleeve can be crimped on by means of a crimping tool. Alternatively, it can also be arranged in a resilient manner to compress the clamping fingers by means of its spring force.

Instead of a single brush wire or a plurality of brush wires, a prefabricated multi-fiber brush in which the ends of the brush wires are joined by a sleeve can be held by the clamping fingers. The term of multi-fiber brush shall generally be understood in this case as a multi-wire brush with several brush wires. It is alternatively referred to as a bundle brush.

In a further embodiment, the clamping fingers of the first holding plate are arranged in such a way that they can be crimped around the at least one brush wire. This embodiment may require only one holding plate and the second holding plate can be omitted because the brush wires are already held by the first holding plate alone.

The advantage of the slip ring brushes in accordance with the embodiments over the related devices is the especially simple mechanical configuration. Consequently, an embodiment of a slip ring brush is substantially based on two holding plates which can be produced as simple punched or metal-stamped parts. The mounting of the brush wires is simple and possible without any soldering. As a result, the disadvantages of soldering processing (such as deformation or a change in the spring properties of the brush wires by high soldering temperatures) are reduced or substantially prevented. The fastening of the brush wires between the clamping fingers and the fixing of the brush wires with clamping sleeves lead to a mechanically stable structure, which is operable as a permanently reliable electrical contact even under long-term loads with high vibration amplitudes. In fact, the proposed arrangement is substantially devoid of problems with mechanically loaded soldering points, in which the crystal structure of the solder changes by mechanical loading and which then subsequently breaks up. At the same time, the proposed configuration enables optional exchange and replacement of individual brush wires of a brush when they are worn out. They could be pulled out after the withdrawing the sleeve from the clamping fingers.

BRIEF DESCRIPTION OF THE DRAWINGS

In the following, embodiments of the invention are described based on examples, without limitation of the general inventive concept, and with reference to the drawings.

Figure 1:
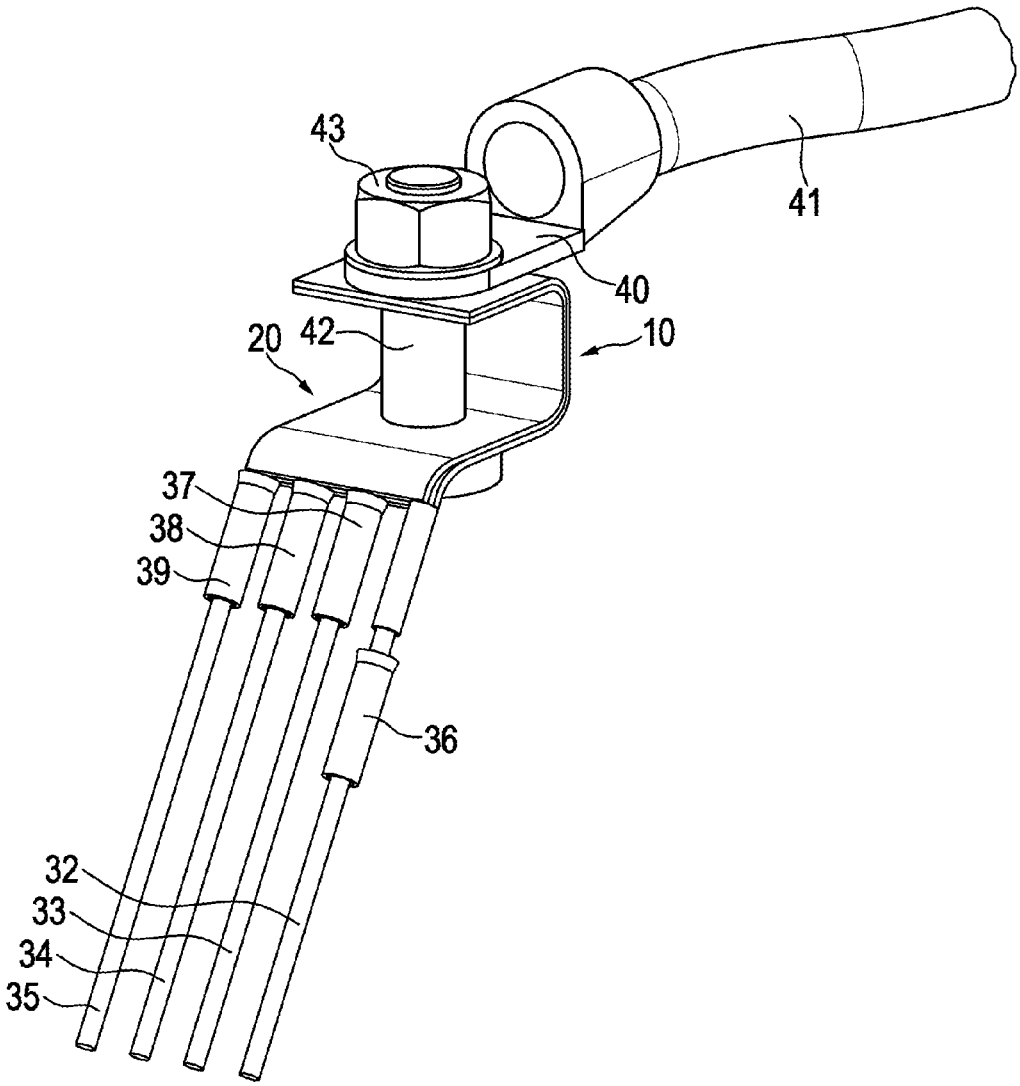
FIG. 1 is a perspective view of a first embodiment of a slip ring brush.

While embodiments of the invention can be appropriately modified, several of such embodiments are shown by way of example in the drawings and described below in detail. It should be understood, however, that the drawings and detailed description are not intended to limit the invention to any particular form disclosed, but on the contrary, the intention is to cover all modifications, equivalents and alternatives falling within the spirit and scope of the present invention as defined by the appended claims.

DETAILED DESCRIPTION

Figure 2:
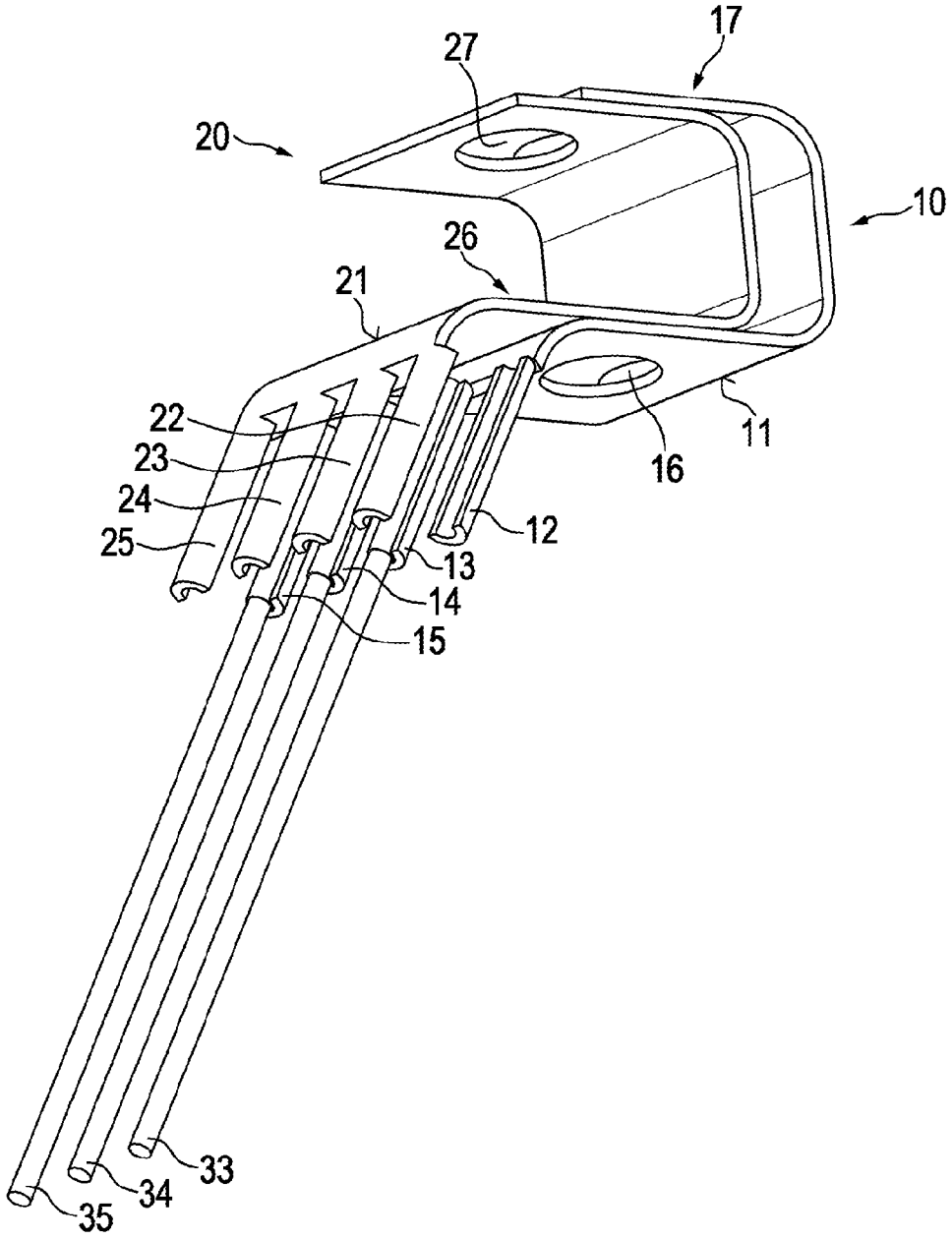
FIG. 2 is an exploded perspective view of a portion of the embodiment of FIG. 1 illustrating its components.

FIG. 1 shows a first embodiment of a slip ring brush assembly. The same slip ring brush is shown in FIG. 2 in a state prior to assembly. A first holding plate 10 and a second holding plate 20 are shaped in such a substantially congruent way that they can be "pushed" into each other and/or inserted into each other to rest on each other and to form areal contact at least within a predetermined area. In reference to FIG. 2, the first holding plate 10 has an attachment area 11 with the first clamping fingers 12, 13, 14, 15. Furthermore, the second holding plate 20 includes an attachment area 21 with the second clamping fingers 22, 23, 24, 25. When the two holding plates 10, 20 are slid into each other as shown in the illustrations of FIGS. 1, 2, the clamping fingers 12, 13, 14, 15 of the first holding plate 10 and the clamping fingers 22, 23, 24, 25 of the second holding plate 20 are disposed opposite one another in pairs (12, 22); (13, 23); (14, 24); (15, 25) to form a cavity for accommodating brush wires 32, 33, 34, 35. Preferably, the clamping fingers are shaped in such a way that they rest on the brush wires to be inserted or encompass or embrace the same as tightly as possible. In one specific case, shown in FIG. 2, the individual clamping fingers are preferably shaped in a semi-cylindrical manner in order to form a cylindrically-hollow opening with a circular cross-section to accommodate the brush wires. The holding plates 10, 20 can be produced in an especially simple and cost-effective way as punched parts. The holding plates may include copper or a copper alloy such as brass or bronze.

Clamping sleeves 36, 37, 38, 39 are provided for tightly affixing the brush wires between the clamping fingers. The position of the first holding plate 10 with respect to the second holding plate 20 can be fixed by the clamping sleeves. As shown in FIG. 1, the clamping sleeve 36 has not yet been slid onto and over the respective clamping fingers (12, 22), whereas the other clamping sleeves 37, 38 and 39 have already been placed on their respective clamping fingers (13, 23); (14, 24); (15, 25). A holding plate is bent into a U-shape to position a first portion of the first holding plate in a substantially parallel relationship to a second portion of the first holding plate. For the purpose of fixing the slip ring brush and for establishing electrical contact, a bolt or screw 42 is provided through a first fixing hole 16 and an opposite second fixing hole 17 of the U-shaped bent first holding plate 10 and a first fixing hole 26 and an opposite second fixing hole 27 of the U-shaped bent second holding plate 20. The first and second fixing holes may be disposed substantially co-axially. Optionally, the position of the first holding plate 10 with respect to the second holding plate 20 is also determined by a fastener such as the bolt or screw secured by a nut 43, for example. At the same time, the same fastener can be used for connecting a cable lug 40 that is further extended with the cable 41 or a connecting plug to the slip ring brush. The holding plates 10, 20 are bent in a U-shaped manner in this embodiment, which enables especially simple spatial coordination, cooperation, and attachment of the holding plates with respect to one another and simple mounting of the slip ring brushes thereon. Generally, the holding plates could also be provided shaped in any other way (for example, flat). The configuration of the clamping fingers, on the other hand, is relevant for the embodiments herein.

Figure 3:
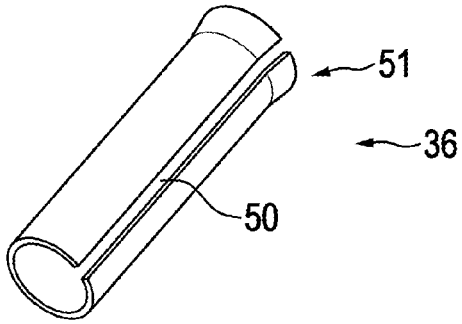
FIG. 3 is a perspective view of a clamping sleeve.

FIG. 3 shows a clamping sleeve 36. It is shown shaped as a hollow cylinder having, preferably, a longitudinal slit along its wall, by means of expansion of which the diameter of the sleeve can be increased. It preferably further includes a collar 51 which facilitates inserting the clamping sleeve onto the clamping fingers.

Figure 4:
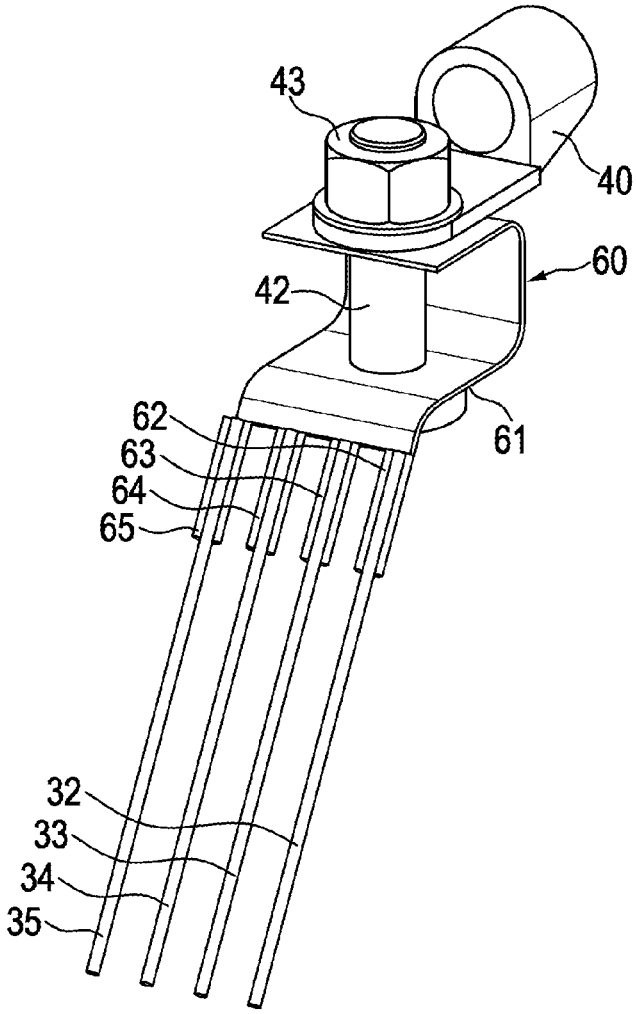
FIG. 4 is a perspective view of a further embodiment of a slip ring brush.

FIG. 4 shows a further embodiment. In this case, only one first holding plate 60 will be used, with the brush wires 32, 33, 34 and 35 being tightly crimped along their length by the crimping fingers 62, 63, 64, 65 which are connected to the attachment area 61 of the first holding plate 60.

Figure 5:
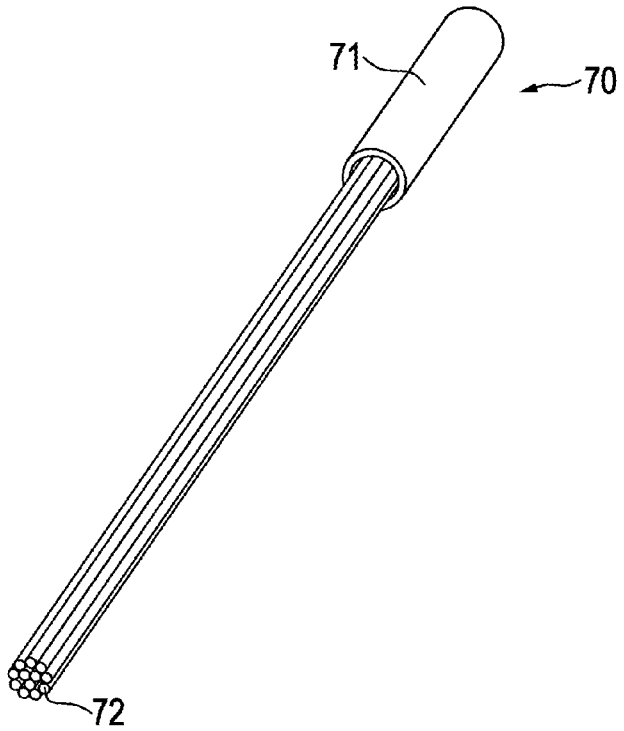
FIG. 5 is a perspective view of a multi-fiber brush.

FIG. 5 shows an embodiment of a multi-fiber brush or a bundle brush 70. This brush includes several individual brush wires 72 brought in a bunch and encompassed by a sleeve 71 at one end. Preferably, the sleeve 71 is crimped onto the individual wires. Alternatively or in addition, the sleeve 71 can be soldered onto the wires 72. The individual brush wires 72 themselves and/or the sleeve 71 can be held by the clamping fingers.

Figure 6:
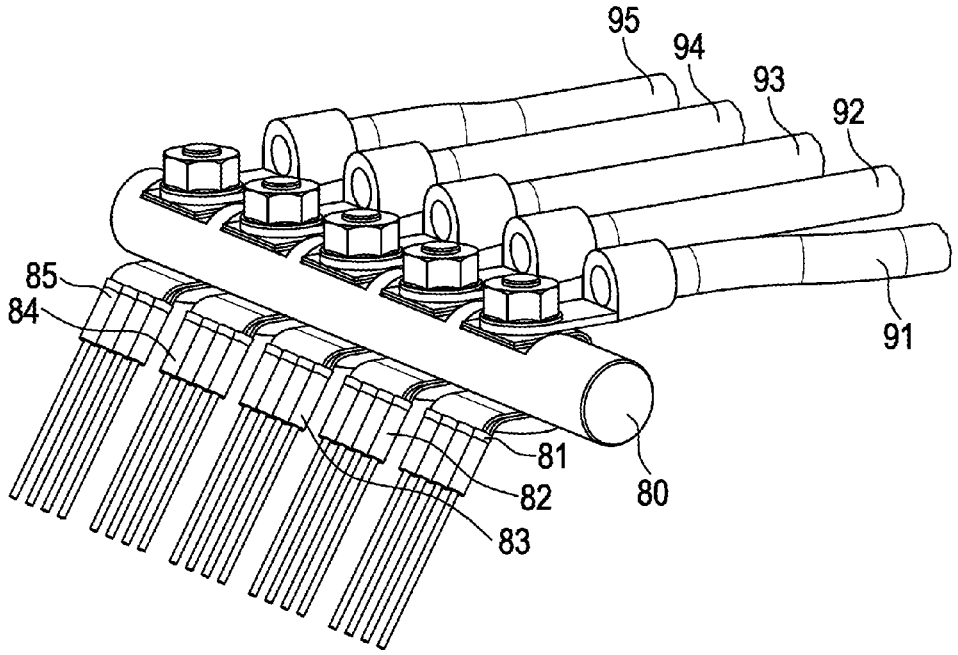
FIG. 6 is a perspective view of a brush block.

FIG. 6 shows a f brush block containing five slip ring brushes 81, 82, 83, 84, 85, which are mounted on a preferably electrically insulated carrier 80. Connecting electrical cables 91, 92, 93, 94, 95 are provided for supplying current to the brushes 81, 82, 83, 84, 85. If several slip ring brushes are to be connected in parallel, then this can occur in an especially simple way by an electrically conductive carrier to which the brushes 81, 82, 83, 84, 85 may be attached.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 First holding plate
11 First attachment area
12-15 First clamping fingers
16 First fixing hole
17 Second fixing hole
20 Second holding plate
21 Second attachment area
22-25 Second clamping fingers
26 First fixing hole
27 Second fixing hole
32-35 Brush wires
36-39 Clamping sleeves
40 Cable lug
41 Connecting cable
42 Bolt
43 Nut
50 Clamping slit
51 Collar
60 Holding plate

61 Attachment area
62-65 Crimping fingers
70 Multi-fiber brush
71 Sleeve
72 Brush wires
80 Carrier
81-85 Brushes
91-95 Connecting cables

The invention claimed is:

1. A slip ring brush, comprising a holding device including a first holding plate with at least one first clamping finger attached thereto at a proximal end of the at least one first clamping finger and a second holding plate with at least one second clamping finger attached thereto at a proximal end of the at least one second clamping finger, wherein the first and second holding plates are shaped such as to enable resting of these plates on each other in a predetermined area when the first and second holding plates are brought together, and wherein, when the first and second plate rest on one another in the predetermined area, the at least one first clamping finger is disposed along and opposite to the at least one second holding finger to form at least one cavity therebetween, the at least one cavity being dimensioned to accommodate the at least one brush wire therein;

at least one brush wire held by the holding device in the at least one cavity; and at least one clamping sleeve disposed over the at least one first clamping finger and the at least one second clamping finger to secure the at least one brush wire in the at least one cavity.

2. A slip ring brush according to claim 1, characterized in that only one brush wire is arranged in a cavity between respectively corresponding first and second clamping fingers.

3. A slip ring brush according to claim 1, characterized in that several brush wires are arranged in a cavity between two respectively corresponding clamping fingers.

4. A slip ring brush according to claim 1, characterized in that a multi-fiber brush is arranged in a cavity between two respectively corresponding clamping fingers.

5. A slip ring brush according to claim 1, characterized in that the first holding plate is bent in a U-shaped manner to form a first U-shaped element and includes a first fixing hole in a first leg of the first U-shaped element and a second fixing hole in a second leg of the first U-shaped element, the first and second fixing holes disposed opposite each other, and in that the second holding plate is bent in a U-shaped manner to form a second U-shaped element and includes a third fixing hole in a first leg of the second U-shaped element and a fourth fixing hole in a second leg of the second U-shaped element, the third and fourth fixing holes disposed opposite each other.

6. A slip ring brush according to claim 5, further comprising a fastener disposed through the first, second, third, and fourth fixing holes to affix the first and second holding plates to one another.

7. A slip ring brush with at least one brush wire that is held by a holding device, characterized in that the holding device of said slip ring brush includes a holding plate connected to at least one first crimping finger with at least one brush wire being crimped onto said at least one first crimping finger, wherein the holding plate includes at least one hole dimensioned to accommodate a fastener therethrough, the fastener enabling affixation of the holding device and electrical contact with the at least one brush wire.

8. A slip ring brush according to claim 7, characterized in that precisely one brush wire is crimped onto a crimping finger.

9. A slip ring brush according to claim 7, characterized in that several brush wires are crimped onto a crimping finger.

10. A slip ring brush according to claim 7, characterized in that a multi-fiber brush is crimped onto a crimping finger.

11. A slip ring brush according to claim 7, characterized in that the holding plate is bent in a U-shaped manner to form a U-shaped element and includes, in a first leg of the U-shaped element, a first fixing hole and, in a second leg of the U-shaped element, a second fixing hole disposed opposite the first fixing hole.

12. A slip ring brush according to claim 11, further comprising a fastener inserted through the first and second fixing holes to affix the slip ring brush to an external electrical connector.

* * * * *